US011613454B2

(12) United States Patent
Sevcik

(10) Patent No.: US 11,613,454 B2
(45) Date of Patent: Mar. 28, 2023

(54) BEVERAGE DISPENSERS FOR DISPENSING MIXED BEVERAGES WITH ONE OR MORE GASES INJECTED THEREIN

(71) Applicant: Marmon Foodservice Technologies, Inc., Osseo, MN (US)

(72) Inventor: E. Scott Sevcik, Crystal Lake, IL (US)

(73) Assignee: Marmon Foodservice Technologies, Inc., Osseo, MN (US)

( * ) Notice: Subject to any disclaimer, the term of this patent is extended or adjusted under 35 U.S.C. 154(b) by 419 days.

(21) Appl. No.: 16/721,230

(22) Filed: Dec. 19, 2019

(65) Prior Publication Data

US 2020/0207603 A1 Jul. 2, 2020

Related U.S. Application Data

(60) Provisional application No. 62/786,071, filed on Dec. 28, 2018.

(51) Int. Cl.
*B67D 1/00* (2006.01)
*B01F 23/236* (2022.01)

(52) U.S. Cl.
CPC ..... *B67D 1/0077* (2013.01); *B01F 23/2362* (2022.01); *B67D 1/005* (2013.01); *B67D 1/0045* (2013.01); *B67D 1/0085* (2013.01); *B67D 2210/00047* (2013.01)

(58) Field of Classification Search
CPC ..... B67D 1/0057–0077; B67D 1/0045; B67D 1/0051; B67D 1/0052; B67D 1/005; B67D 1/0085; B67D 2210/00047; B01F 23/2362
See application file for complete search history.

(56) References Cited

U.S. PATENT DOCUMENTS 3,881,636 A * 5/1975 D'Aubreby ..... B67D 1/0071 141/51
4,676,401 A * 6/1987 Fox ..... B67D 1/0044 222/1
5,565,149 A * 10/1996 Page ..... B67D 1/1252 261/DIG. 7
5,703,748 A * 12/1997 Fulks ..... H01H 47/325 361/195
5,803,320 A * 9/1998 Cutting ..... B67D 1/0871 222/129.1
5,842,600 A * 12/1998 Singleterry ..... B01F 23/2363 261/DIG. 7
6,273,295 B1 * 8/2001 Quartarone ..... B67D 1/0009 222/129.1

(Continued)

OTHER PUBLICATIONS

International Search Report and Written Opinion for PCT/US2019/067931, dated Mar. 18, 2020.

*Primary Examiner* — Frederick C Nicolas
*Assistant Examiner* — Randall A Gruby
(74) *Attorney, Agent, or Firm* — Andrus Intellectual Property Law, LLP

(57) ABSTRACT

A beverage dispensing machine for dispensing a mixed beverage has a first inlet configured to receive a concentrate; a second inlet configured to receive a base fluid; a gas inlet configured to receive a gas; a gas injection device configured to pulsate the gas into the concentrate such that the gas agitates the concentrate and is injected into the concentrate to form a gas-injected concentrate; and a dispensing valve configured to dispense the base fluid and the gas-injected concentrate.

15 Claims, 7 Drawing Sheets

(56) References Cited

U.S. PATENT DOCUMENTS

| | | | | |
|---|---|---|---|---|
| 8,881,948 | B1 | 11/2014 | Lassota | |
| 2002/0170925 | A1* | 11/2002 | Friedman | B67D 1/1281 222/129.1 |
| 2011/0241230 | A1 | 10/2011 | Kerfoot | |
| 2013/0062366 | A1* | 3/2013 | Tansey | B67D 1/0809 222/101 |
| 2017/0055552 | A1* | 3/2017 | Giardino | B01F 25/313311 |
| 2018/0213824 | A1 | 8/2018 | Schacht et al. | |
| 2018/0236417 | A1 | 8/2018 | Wilburn Borders | |
| 2019/0364932 | A1 | 12/2019 | Lisiecki | |

* cited by examiner

BEVERAGE DISPENSERS FOR DISPENSING MIXED BEVERAGES WITH ONE OR MORE GASES INJECTED THEREIN

CROSS-REFERENCE TO RELATED APPLICATION

The present disclosure is based on and claims priority to U.S. Provisional Patent Application No. 62/786,071 filed Dec. 28, 2018, the disclosure of which is incorporated herein by reference in entirety.

FIELD

The present disclosure relates to beverage dispensing machines, and specifically to beverage dispensing machines for dispensing mixed beverages containing one or more gases.

BACKGROUND

The following U.S. Patents are incorporated herein by reference in entirety.

U.S. Pat. No. 5,035,121 discloses an agitating and pumping device for use with a beverage cooling and dispensing ice-bank system. The ice-bank includes a reservoir for holding water and refrigerating coils therein for cooling the water. A heat exchange circuit is in a heat exchange relationship with the reservoir water for cooling beverage circulated therethrough.

U.S. Pat. No. 5,129,549 discloses a beverage dispensing valve having a valve body that will accept beverage flow controls, water and syrup valves that are interchangeable in either of two fluid ports, a reversible block between the valves and a nozzle that enables syrup to be used in either port and water to be used in either port, a positively sealing and easily removable nozzle for improved sanitation and mixing, and multiple fulcrums in the valve body that will respectively accept a manual actuator or a switch actuator and a solenoid driven actuator.

U.S. Pat. No. 5,269,442 discloses a nozzle for a post-mix beverage dispensing valve that optimizes flow of fluids. The nozzle includes a first diffuser plate followed by a central flow piece having a frusto-conical outer water flow surface and an interior syrup flow channel. Second and third diffuser plates follow the frusto-conical portion. The second and third diffuser plates have perimeter edges that contact the inner surface of a nozzle housing so that the carbonated water must flow through holes in the diffusers.

U.S. Pat. No. 5,285,815 discloses a post-mix beverage dispensing valve having a quick disconnect mounting and easily detachable valve cover housing and valve actuating lever. The quick disconnect includes a body having a pair of parallel shafts extending therethrough.

U.S. Pat. No. 5,368,198 discloses a beverage dispenser having a flat carbonator along one end of an ice bank cooled water bath tank. A plurality of syrup coils are arranged along an interior surface of the carbonator. An evaporator extends around a central perimeter of the water bath tank creating a central opening through which an agitator shaft and blade extend for operation by an agitator motor.

U.S. Pat. No. 5,535,600 discloses a cooling system for post-mix beverage dispenser including an ice bath tank for holding a liquid, a refrigeration circuit for cooling the liquid in the ice bath tank, a concentrate storage area, and a cooling circuit coupled to the ice bath tank, for cooling the concentrate storage area. A pump in the cooling circuit transfers the liquid from the ice bath tank to a coil in the concentrate storage container. The circuit returns the liquid to the ice bath tank and creates the turbulence necessary for the liquid to freeze evenly in the tank.

U.S. Pat. No. 5,607,083 discloses a post-mix beverage dispensing valve having a nozzle that provides for higher flow rates. The valve is designed to provide for an electronic switch/control module separate from the valve housing cover, and the valve includes improved banjo valves and accompanying seat structures providing for increased fluid flow and for fluid flow that is less turbulent.

U.S. Pat. No. 5,792,391 discloses a carbonator having a tube cylinder with a closed end and an open end. A disk is removably retained in the open end for providing access into the interior volume thereof. The disk provides for mounting thereto of water and carbon dioxide gas inlets, a carbonated water outlet, a safety relief valve, and a water level sensor.

U.S. Pat. No. 5,845,815 discloses a piston based flow control for use in a high flow beverage dispensing valve. The piston includes a top perimeter edge structure that allows for continuity of fluid flow during high flow applications and particularly during the initiation of a high flow dispensing so as to eliminate chattering of the piston.

U.S. Pat. No. 5,901,884 discloses a beverage dispenser that includes an outer housing having a water bath tank therein and a refrigeration retaining component area therein positioned directly adjacent and next to the water bath tank. A refrigeration chassis provides for retention and carrying of a refrigeration system including a compressor, a condenser, and a powered cooling fan and an evaporator.

U.S. Patent Application Publication No. 2017/0055552 discloses a gas injection system for injection a gas into a liquid to form a solution and includes a flow channel that conveys a liquid from an upstream inlet configured to receive the liquid and a downstream outlet configured to dispense the solution, a sparger positioned in the flow channel, a solution pressure detection device configured to sense a pressure of the solution in the flow channel, and a liquid valve configured to regulate flow of the liquid in the flow channel based on the pressure sensed by the solution pressure detection device. The sparger is configured to inject the gas into the liquid through the porous surface as the liquid flows across the surface.

U.S. Patent Application Publication No. 2017/0290350 discloses a gas infused milk product and methods of making such product, wherein the gas infused milk product includes a lactose hydrolyzed concentrated milk infused with a soluble gas. Such methods include providing milk (skim milk, 1% milk, 2% milk, whole milk, half and half, cream or other milk product) and concentrating and hydrolyzing the mild with lactase to form a lactose hydrolyzed milk concentrate. The milk can be concentrated in a vacuum in order to remove the dissolved gasses from the lactose hydrolyzed milk concentrate. Soluble gasses, such as nitrous oxide or carbon dioxide are then introduced into the lactose hydrolyzed milk concentrate to form a gas infused milk concentrate. The gas infused milk concentrate is then introduced into a stream of carbonated or still water resulting in a gas infused milk beverage.

U.S. Patent Application Publication No. 2017/0332672 discloses a beverage machine with a gas dissolution assembly that includes a pressure vessel having an open end and a top cap that couples with the open end of the pressure vessel. The top cap has a gas inlet through which a gas to be infused into the beverage flow. A clamping mechanism clamps the top cap onto the open end of the pressure vessel.

A gas infusing device that is coupled to the gas inlet has a porous element that infuses the gas into the beverage.

International Publication No. WO 2018/023713 discloses a beverage mixing assembly for mixing a gas into a liquid to thereby form a solution and includes a mixer body having a first upstream inlet configured to receive the gas, a second upstream inlet configured to receive the liquid, and a downstream outlet configured to dispense the solution from the mixer body. The first upstream inlet defines a first orifice configured to spray the gas into the mixer body and the second upstream inlet defines a second orifice configured to spray the liquid into the mixer body such that the gas collides into the liquid as the liquid conveys from the second upstream inlet to the downstream outlet to thereby mix into the liquid and form the solution.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. One general aspect includes a beverage dispensing machine for dispensing a mixed beverage. The beverage dispensing machine also includes a first inlet configured to receive a concentrate. The beverage dispensing machine also includes a second inlet configured to receive a base fluid. The beverage dispensing machine also includes a gas inlet configured to receive a gas. The beverage dispensing machine also includes a gas injection device configured to pulsate the gas into the concentrate such that the gas agitates the concentrate and is injected into the concentrate to form a gassified concentrate. The beverage dispensing machine also includes a dispensing valve configured to dispense the base fluid and the gassified concentrate. Other embodiments of this aspect include corresponding computer systems, apparatus, and computer programs recorded on one or more computer storage devices, each configured to perform the actions of the methods.

Implementations may include one or more of the following features. The beverage dispensing machine where the dispensing valve is configured to dispense the gas-injected concentrate and the base fluid separately into a container to thereby form the mixed beverage. The beverage dispensing machine where the dispensing valve is configured to mix the gassified concentrate and the base fluid within a nozzle. The beverage dispensing machine where the gas injection device includes a solenoid valve. The beverage dispensing machine where the dispensing valve is electrically connected to the solenoid valve and where the solenoid valve is activated upon opening of the dispensing valve. The beverage dispensing machine further including a controller that electrically connects the dispensing valve to the solenoid valve. The beverage dispensing machine where the controller further operates to control at least one of a pulse rate and duty cycle of the operation of the solenoid valve. 7. the beverage dispensing machine where the controller further operates to control at least one of a pulse rate and duty cycle of the operation of the solenoid valve. the beverage dispensing machine where the pulse rate is between 5-15 pulses per second. The beverage dispensing machine where the duty cycle is between 25%-75%. The beverage dispensing machine further including a Venturi fitting disposed between the first inlet and the gas injection device, the Venturi fitting including an injection chamber configured to receive a flow of concentrate and receive pulses of gas from the gas injection device into the flow of concentrate through the injection chamber. The beverage dispensing machine where the Venturi fitting further includes a Venturi opening configured to increase a flow velocity of concentrate and gas to form a combined mixture of gas and concentrate. The beverage dispensing machine further including a cooling coil disposed between the first inlet and the Venturi fitting, the cooling coil configured to cool the concentrate to a predetermined temperature. The beverage dispensing machine further including a chilled media bath surrounding the cooling coil and configured to cool the cooling coil. The beverage dispensing machine further including where the gas injection device includes a solenoid valve electrically connected to the dispensing valve through a controller that operates to activate the solenoid upon opening of the dispensing valve and operates to control at least one of the pulse rate of the solenoid and the duty cycle of the solenoid. The beverage dispensing machine where controller operates to control the pulse rate between 5-15 pulses per second and operates to control the duty cycle is between 25%-75%. The beverage dispensing machine where the gas includes nitrogen. The beverage dispensing machine further including a carbonator connected to the second inlet, where the carbonator carbonates the base fluid. Implementations of the described techniques may include hardware, a method or process, or computer software on a computer-accessible medium.

One general aspect includes a method of forming a mixed beverage. The method also includes receiving a concentrate via a first inlet. The method also includes receiving a base fluid via a second inlet. The method also includes receiving a gas via a gas inlet. The method also includes pulsating the gas into the concentrate to thereby agitate the concentrate and cause the gas to inject into the concentrate, thereby forming a gas-injected concentrate. Other embodiments of this aspect include corresponding computer systems, apparatus, and computer programs recorded on one or more computer storage devices, each configured to perform the actions of the methods.

Implementations may include one or more of the following features. The method where the gas is pulsated into concentrate in a Venturi fitting to form a combined mixture of concentrate and gas and further including increasing a velocity of the combined mixture of concentrate and gas through a Venturi opening of the Venturi fitting. The method further including cooling the concentrate to a predetermined temperature prior to the Venturi fitting. Implementations of the described techniques may include hardware, a method or process, or computer software on a computer-accessible medium.

BRIEF DESCRIPTION OF THE DRAWINGS

The present disclosure refers to the following Figures. The same numbers are used throughout the Figures to reference like features and components.

DETAILED DESCRIPTION OF THE DRAWINGS

Figure 1:
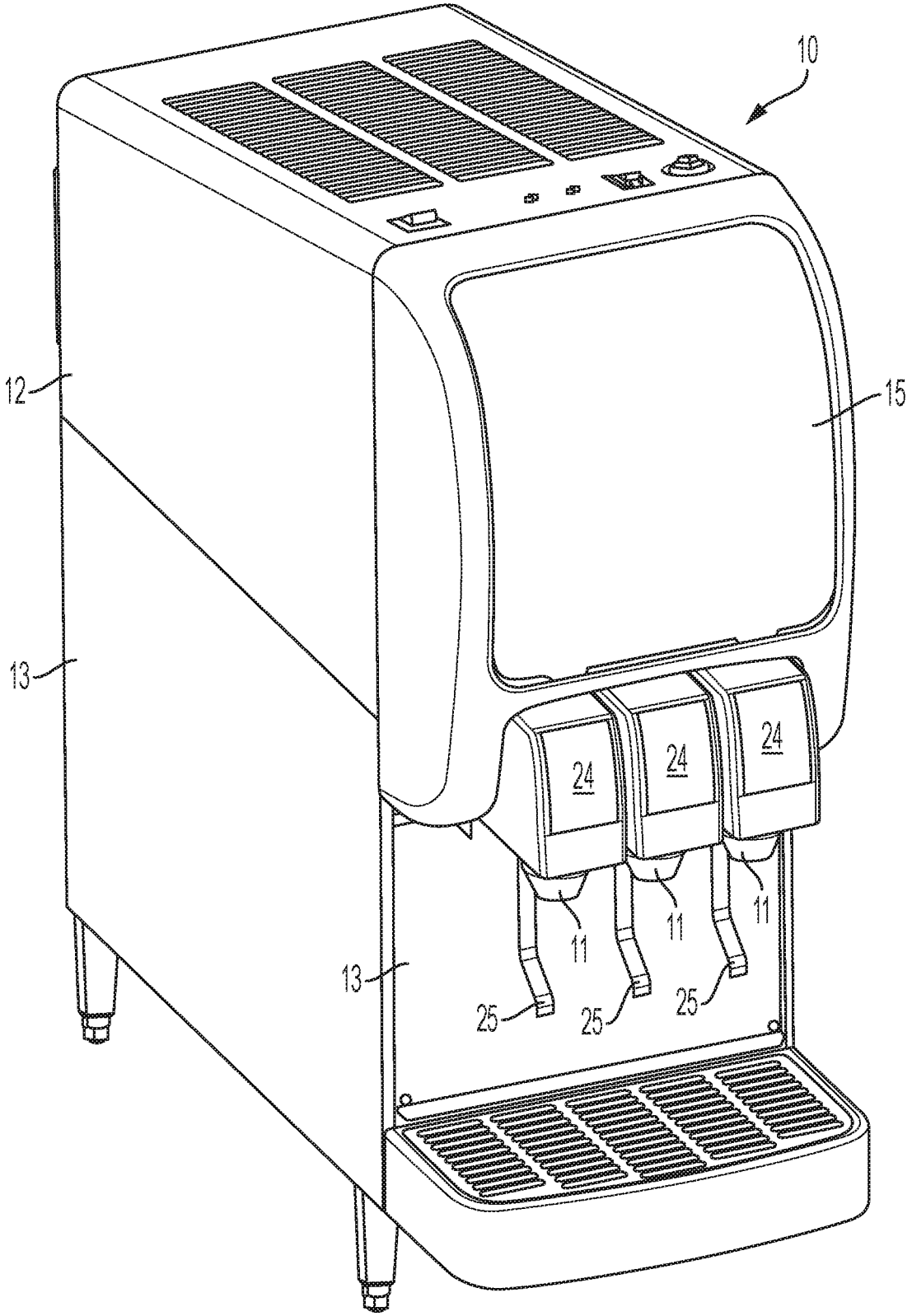
FIG. 1 is a perspective view of an example beverage dispensing machine according to the present disclosure.

Conventional mixed beverage dispensing machines are often configured to dispense a base fluid and a concentrate to a beverage cup or other receptacle, to thereby provide a mixed beverage for consumption by a consumer. In some examples, these machines are configured to dispense a base fluid that contains a gas and a flavor concentrate. For example, some machines are configured to dispense a carbonated base fluid together with a flavored syrup thereby form a flavored, carbonated, mixed beverage.

Mixed beverages containing air (78% nitrogen) or pure nitrogen gas (N2) or a combination thereof are also becoming increasingly popular. Such nitrogenated beverages often provide a unique texture (feel) and taste, particularly due to N2, which is different from the texture and taste of CO2. This is in part due to nitrogen gas molecules being smaller and more inert than CO2. Consumers sometimes describe nitrogenated beverages as being smoother and less acidic than carbonated beverages. In addition, N2 typically produces a visually pleasing "cascading" effect in the beverage cup, due to the way in which N2 physically separates from the mixed beverage.

Through research and experimentation, the present inventor has endeavored to improve upon the above-described prior art beverage dispensers, and particularly upon prior art beverage dispensers that are configured to dispense a mixed beverage containing a gas such as N2. Through research and experimentation, the present inventor has determined that, in many examples, N2 that is injected into a base fluid, such as water, often rapidly separates from the base fluid in an uncontrolled and/or undesirable way (for example causing foaming). The inventor has determined that this is because N2 is an inert gas that does not readily absorb into water or other "Newtonian fluids".

Through further research and experimentation, the present inventor determined that N2 can be more easily injected into a concentrate constituent of a mixed beverage comprising at least one base fluid and at least one concentrate. Concentrates, including fluids containing sweetness or other additives, are non-Newtonian fluids. Non-Newtonian fluids change their viscosity or flow behavior in response to a stress force. This change may be thixotropic, rheopectic, shear thinning, or shear thinning. Non-Newtonian fluids include so-called concentrates, which can have a relatively high concentration of sugars resulting in a fluid with a greater density or body and which exhibits a greater viscosity change with temperature. Concentrates may additionally include a thickener/viscosity enhancer (e.g. pectin) to further increase the viscosity of the concentrate. Concentrates are also typically thixotropic or shear thinning in response to stress. Concentrates have increased surface tension for example from the additional molecules in the concentrate providing the sweetness, flavor, or other additive to the final mixed beverage. This surface tension helps to entrain the N2 gas within the fluid. Additional reference is made to Kumagai, et. al., "Effects of Kinematic Viscosity and Surface Tension on Gas Entrainment Rate of an Impinging Liquid Jet", *Journal of Chemical Engineering of Japan* (1982), which is incorporated herein by reference in its entirety. The present inventor has also determined that when N2 is injected into non-Newtonian fluids including fluids with sugar, the "cascading effect" of N2 separating out of the mixed beverage can advantageously be more easily predicted/controlled, to thereby produce more desirable foaming and/or cascading attributes.

Based upon the above realizations and conceptions, and through further research and experimentation, the present inventor discovered that N2 can be injected into concentrates having a variety of viscosities, including for example concentrates having between a 4:1 dilution ratio to a 9:1 dilution ratio. In still further examples, the concentrates may have between a 5:1 dilution ratio to a 9:1 dilution ratio. While a variety of sweeteners may be used in concentrates, including, but not limited to high fructose corn syrup and sucrose. The sweetness of these concentrates may exemplarily have a sweetness content in the range of 1.0-14.0 degree Brix. In certain examples, the concentrate may be a "light" concentrate having a sweetness content in the range of 1.0-6.0 degree Brix, or a "regular" concentrate having a sweetness content in the range of 6.0-14.0 degree Brix. In certain examples, the concentrate may have a sweetness content in the range of 1.0-3.0 degree Brix, 3.0-6.0 degree Brix, 6.0-9.0 degree Brix, or 9.0-14.0 degree Brix, or any combination thereof, e.g., 1.0-9.0 degree Brix, 3.0-9.0 degree Brix, or 3.0-14.0 degree Brix.

Through research and experimentation, the present inventor has discovered that in certain examples, injection of N2 into a concentrate advantageously inhibits the growth of bacteria in the mixed beverage, due to the fact that N2 is an inert gas.

Based upon the above realization and conceptions, the present inventor further conceived of the beverage dispensing machines described hereinbelow, examples of which are particularly configured for dispensing mixed beverages containing one or more gases, and particularly gases such as N2 according to the novel principles described herein.

Figure 2:
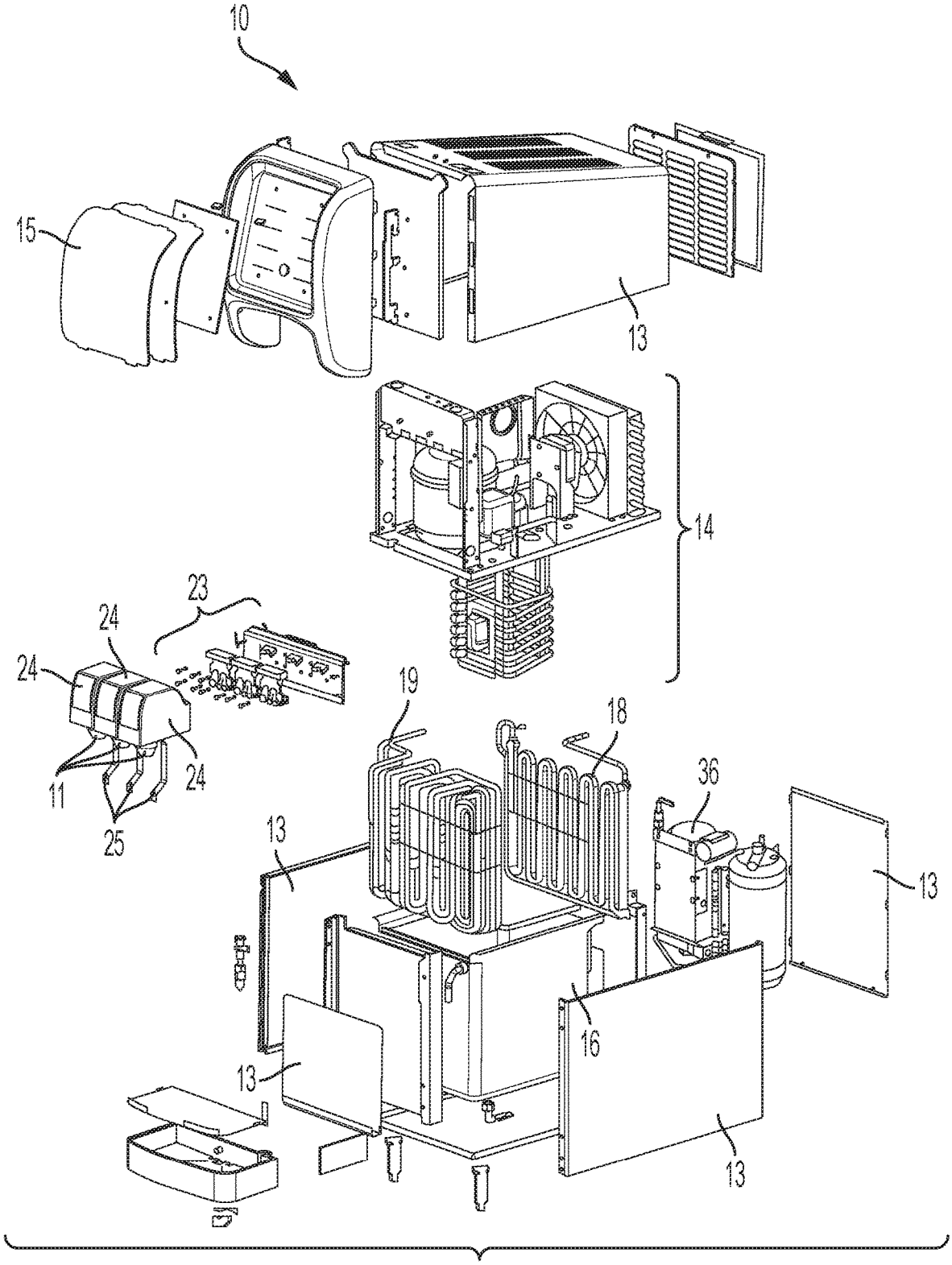
FIG. 2 is an exploded view of the beverage dispensing machine of FIG. 1.

FIGS. 1-2 depict a mixed beverage dispensing machine 10 for dispensing a mixed beverage. FIG. 2 is an exploded view of the dispensing machine 10 depicted in FIG. 1. The dispensing machine 10 is configured to receive a supply of base fluid (e.g., a diluent, carbonated water, and/or still water) and a supply of concentrate (e.g., solvent, flavoring syrup, and/or high-ratio syrup). The dispensing machine 10 has a housing 12 with outer panels 13, including side panels, top and bottom panels, and an electronic display panel 15. A cooling and refrigeration system 14 (FIG. 2) is contained within the housing 12 and includes a cooling media bath 16. The type and configuration of the cooling and refrigeration system can vary from what is shown and described. In the illustrated example, a cooling media bath 16 contains a cooling media, such as water, which is cooled by the cooling and refrigeration system 14, which can include any conventional refrigeration system, including condensers, evaporators, fans, and the like.

A first cooling coil 18 is configured to convey the base fluid through the cooling bath so that the base fluid exchanges heat with and is cooled by the cooling media bath 16. A second cooling coil 19 is configured to convey the concentrate through the cooling media bath 16, such that the concentrate exchanges heat with and is cooled by the cooling media bath 16. Note that the dispensing machine 10 can include any suitable type of cooling and refrigeration system for cooling the base fluid and/or the concentrate. In examples disclosed herein, the base fluid and the concentrate can be cooled by the same cooling and refrigeration system or by separate and distinct cooling and refrigeration systems. Examples of suitable refrigeration systems, such as what is illustrated, are disclosed in the above-incorporated U.S. Pat. Nos. 5,035,121; 5,535,600; and 5,901,884.

A backblock manifold 23, as described herein, receives the base fluid and gasified concentrate, and directs these received constituents to a plurality of dispensing valves 24, each of which has a nozzle 11 for dispensing the base fluid and the concentrate to a beverage cup or other receptacle. In use, a consumer selects a desired mixed beverage (e.g., nitrogenated orange soda; lemon-lime soda having multiple gases injected therein; and/or the like) and the desired mixed beverage is dispensed to the beverage cup or another receptacle. The type and/or configuration of the dispensing valves 24 can vary from what is shown. In the illustrated example, the dispensing valves 24 are opened when the consumer pivots a mechanical lever arm 25, which in turn closes a switch and energizes a solenoid valve. Examples of such an arrangement are disclosed in the above-incorporated U.S. Pat. No. 5,285,815. In other examples, the dispensing valves 24 are connected to a controller 200 (FIG. 5) which automatically operates the dispensing valve 24 based on inputs received via a user input device 205 (FIG. 5) which may be a different type of user input device than a mechanical lever arm, including but not limited to a touch-sensitive graphical display as will be further described hereinbelow.

Figure 3:
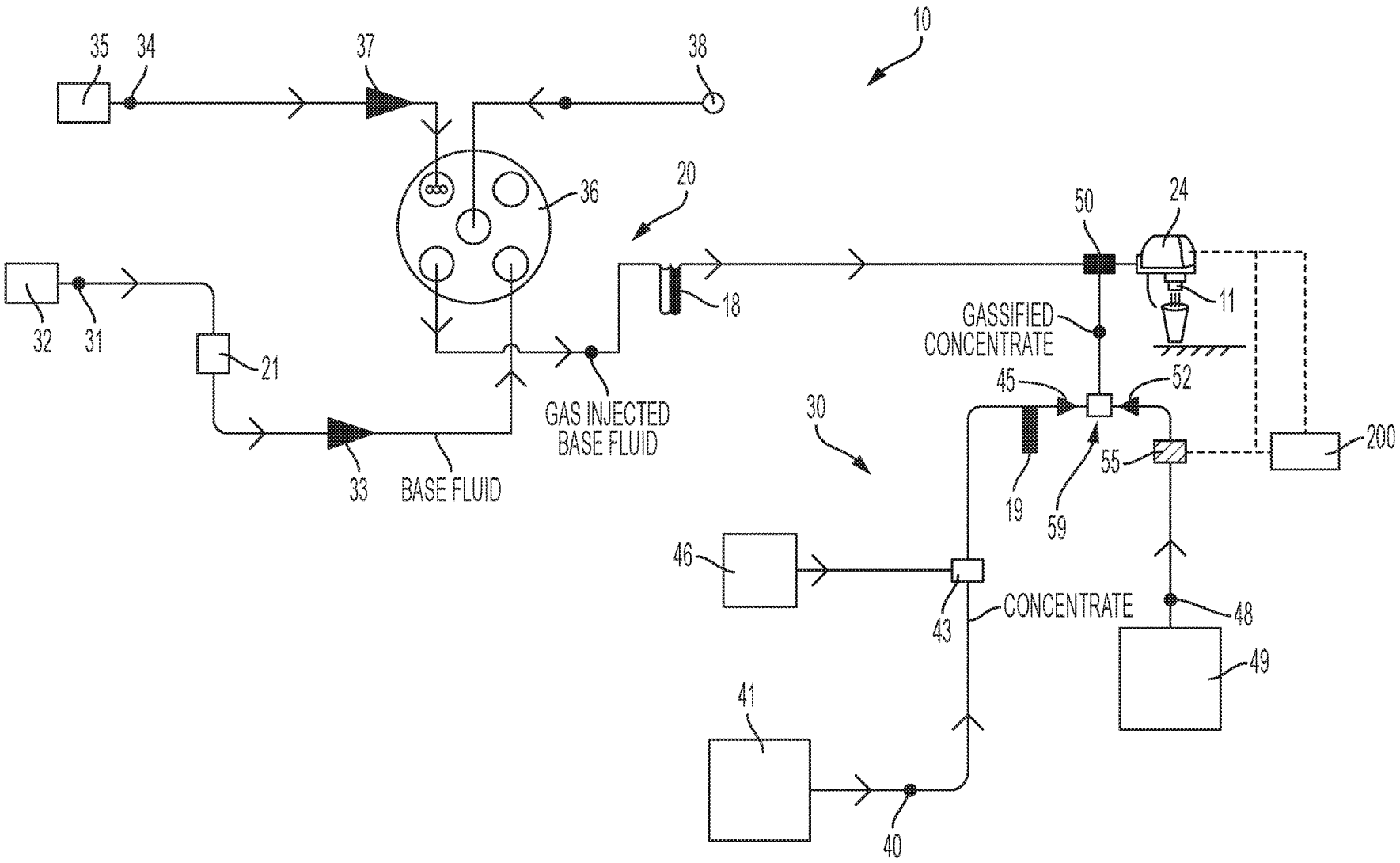
FIG. 3 is a schematic diagram of an example of a beverage dispensing machine according to the present disclosure.

FIG. 3 schematically depicts an example of the beverage dispensing machine 10 according to the present disclosure. The beverage dispensing system includes a base fluid system 20 and a concentrate system 30. The base fluid provided by the base fluid system 20 combines with the concentrate from the concentrate system 30 at an fitting 50, before being dispensed through valve 24 and nozzle 11 as described in detail herein.

The base fluid system 20 exemplarily includes a base fluid inlet 31 which receives a base fluid (e.g., water) from a base fluid source 32 (e.g., a pressurized water tank, a building water supply, a municipal water source, and/or the like). In certain examples, a base fluid pump 21 is provided to pump the base fluid through the dispensing machine 10, which increases the pressure of the base fluid in the dispensing machine 10 to overcome the gas pressure from a carbonator 36 as described in further detail herein. The type of pump is conventional and can be an electrically-powered pump and/or a mechanically powered pump, such as is commercially available from Procon, model number 114.

The base fluid is conveyed through a conventional check valve 33 to a carbonator 36, it will be recognized that in other examples, other gas injection devices may be used besides a carbonator 36, for example for N2 or air injected base fluids. Carbonators are known in the art, examples of which are disclosed in the above-incorporated U.S. Pat. Nos. 5,368,198 and 5,792,391.

The carbonator 36 receives a gas, in this example CO2 from a gas source 34 (e.g., pressurized gas tank and/or the like) through a gas inlet 35. It will be recognized, as noted above, that other gases, for example, Nitrogen or air may be alternatively injected into the base fluid. In the present example, CO2 flows through a check valve 37 into the carbonator 36.

The carbonator 36, as described herein injects the CO2 into the base fluid to form carbonated water (or another gas-injected base fluid in other examples). In an example, the carbonator 36 forms a pressure head (e.g. 75 psi) in a pressure tank that is greater than the pressure of the base fluid provided by the base fluid pump (e.g. 65 psi). When the valve 24 is opened, the created pressure gradient injects the CO2 into the base fluid as the base fluid is propelled through the fitting 50 and the valve 24 by the injected CO2. A system of rigid and/or flexible tubing interconnects the components of the base fluid system 20, and through which the base fluid flows. The gas-injected base fluid is directed towards the valve 24 through the first cooling coil 18. As previously noted, the first cooling coil 18 is within the cooling bath (FIG. 2) and functions to cool the base fluid to the controlled temperature of the cooling bath, for example, 45° F., before dispensing the base fluid through the fitting 50 and the open valve 24. The fitting 50 may exemplarily be a part of, or connected to, the backblock manifold 23 (FIG. 2) as described above. The carbonator 36 may include a relief valve 38, which vents the CO2 gas from the carbonator 36 if a pressure of the CO2 exceeds a preselected maximum pressure.

The concentrate system 30 operates as described herein to gasify concentrate with a Nitrogen gas, for example, N2 or air. A concentrate source 41 (e.g., a conventional bag-in-box container) provides the concentrate to the concentrate system 30 through a concentrate inlet 40. The concentrate is pumped from the concentrate source 41 by a pump, for example, a syringe pump, the pump 43 is driven by a pressurized gas source 46. This pressurized gas source 46 may be a cylinder of compressed CO2 gas or may be a pneumatic pump. This type of pneumatic pump is commercially available, for example from Flojet, model number T5000. In other examples, the pump 43 can be any suitable electrically or mechanically driven pump for pumping concentrate. In still other examples, the concentrate source 41 itself is pressurized (e.g., via a pressurized concentrate tank), such that the pump 43 can be omitted. When the dispensing valve 24 is opened, the pressurized concentrate flows through the concentrate system 30 as described herein through rigid and/or flexible tubing and is provided to the fitting 50 for combination with the base fluid. This rigid and/or flexible tubing may include the cooling coil 19, which, as described above, passes through the cooling media bath 16 and cools the concentrate to exemplarily the same temperature (e.g. 45° F.) as the base fluid.

Figure 4:
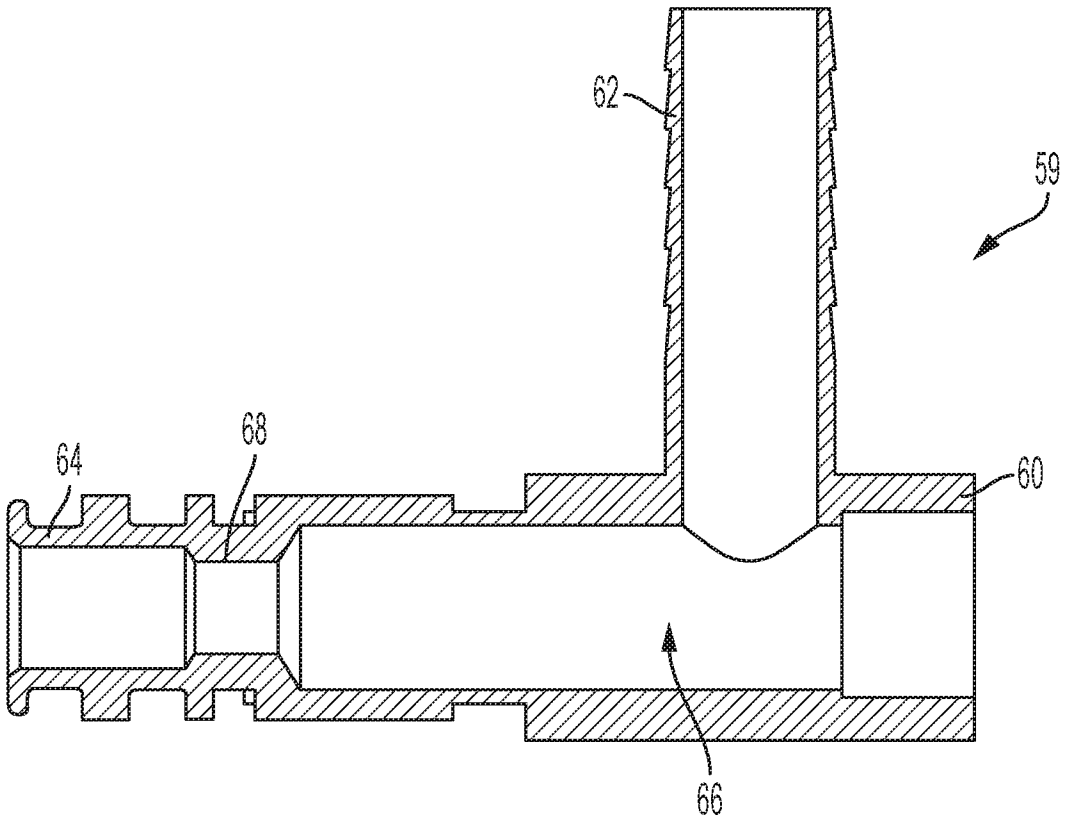
FIG. 4 depicts an example of a Venturi fitting as used in examples of the beverage dispensing machine.

The concentrate system 30 further operates to gasify the concentrate before the concentrate combines with the base fluid at the fitting 50. This is exemplarily done with a nitrogen-containing gas (e.g. N2 or air). This gasification gas, which in this example will be N2 gas, is provided from a gas source 49 through a gas inlet 48. The gas source 49 can be a conventional pressurized gas tank. In other examples, N2 gas can be provided by an N2 generator. Non-limiting examples of N2 generators use adsorption to adsorb CO2, water, and other molecules from the air, leaving the remaining N2 gas. Other examples of a gas source 49 may include an air compressor which pressurizes ambient air for use in examples with air as the gasification gas. A gas injection device, exemplarily a solenoid valve 55, controls the delivery of the N2 gas into the concentrate. While a solenoid valve is used for exemplary purposes, the gas injection device may include other forms of pulse valves for example, driven by motors, air pressure, or concentrate pressure. Still further examples of other forms of pulse valves may be those activated by cams or using diaphragms. The gas is injected into the concentrate at an injection point which is exemplarily a Venturi fitting 59, which is depicted in FIG. 4 and described in further detail with respect to that figure. It will be recognized that, while not so depicted in the schematic diagram of FIG. 3, the Venturi fitting 59 may be directly connected to the backblock manifold 23, which may contain the fitting 50, as described above. The gas is provided from the gas source 49 to the gas injection device (e.g. solenoid valve 55) and to the Venturi fitting 59 through rigid and/or flexible tubing. A check valve 52 prevents the backflow of the concentrate towards the solenoid valve 55 when the solenoid valve is not open and/or if the pressure of the gas source 49 were less than the pressure of the concentrate. An example of a suitable solenoid valve is commercially available from Bimba Manufacturing Company. A further example of a suitable solenoid valve is the S10MM series of solenoid valves available from Pneumadyne, Inc. These example solenoid valves may be have a maximum operating pressure of 105 psi, a coefficient of velocity between 0.010 and 0.013, and flow rates between 0.27-0.54 standard cubic feet per minute (SCFM) at 50 psi or between 0.51-1.05 SCFM at 105 psi. However, these are intended to be merely exemplary of characteristics which may be used. Persons of ordinary skill in the art will recognize that a wider variety of alternative valves and valve characteristics may also be suitable for use within the scope of the present disclosure and that changes in valve type, dimensions, or use would similarly result in differences in operational characteristics.

FIG. 4 depicts a cross-sectional view of a Venturi fitting 59. The Venturi fitting 59 includes a syrup inlet 60 configured to be connected to the concentrate source 41 through the tubing as described above. The Venturi fitting 59 further includes a gas inlet 62, which is exemplarily in the form of a ribbed hose adapter. The gas inlet 62 joins with the syrup inlet 60 inside the Venturi fitting 59 at a perpendicular "T" or another angle. It will be recognized that the angle and the diameter of the gas inlet 62 may be or selected for the specific use and operation configured in view of the examples of the dispenser disclosed. As explained in further detail herein, when the solenoid valve 55 is opened, gas is provided to the flow of concentrate through the Venturi fitting 59, the gasified syrup is directed through the fitting to an outlet 64. The outlet 64 may be directly connected to the backblock manifold 23 (FIG. 2) to provide the gasified syrup to the fitting 50. As previously noted, N2 gas is inert and presents resistance to absorption. Instead, the concentrate system 30 uses the properties of the concentrate to form a semi-stable mixture of the syrup and the nitrogen-containing gas. The gas is injected through the gas inlet 62 into the syrup in an injection chamber 66 of the Venturi fitting 59. After the initial injection of the gas, the combined concentrate and gas mixture flows through a Venturi orifice 68. The narrower cross-sectional area of the Venturi orifice 68 increases the velocity of the combined concentrate and gas mixture. The increase in velocity can cause shear stress, resulting in shear-thinning of the concentrate, which has been found to improve the entrainment of the nitrogen-containing gas within the syrup.

Returning to FIG. 3, the beverage dispensing machine 10 is uniquely configured to provide a nitrogenated mixed beverage through the gasification of the concentrate constituent of the mixed beverage. In addition to the introduction of the nitrogen-containing gas to the concentrate and the Venturi fitting 59 described above, the solenoid valve 55 is operated to rapidly open and close to provide pulses or bursts of the gas into the injection chamber 66 of the Venturi fitting 59. This intermittent injection of the gas into the concentrate agitates the concentrate and creates turbulent flow and shear in the concentrate. In examples, the flow rate of the concentrate, the pressure of the gas, the diameter/size of the injection chamber 66 and the resulting size of the gas pulses into the concentrate in the injection chamber all may affect the mixture of the gas into the concentrate. This exposes more of the concentrate to the gas, improving mixture between the syrup and gas prior to the Venturi orifice 68. Because concentrate exhibits non-Newtonian fluid properties, this thins the concentrate, providing improved entrainment of the second gas into the concentrate. In some examples, the solenoid valve 55 is operated in a range between 4 pulses per second and 15 pulses per second (PPS). The solenoid valve 55 may be operated in a range between 7.5 PPS and 12 PPS. In addition to the pulses per second of the solenoid valve, a duty cycle of the solenoid valve is also controlled. Duty cycles may range between 25%-75%, more specifically 30%-70%, and more specifically 38%-56%. These pulse per second and duty cycle values may depend upon the pressure drop and flow coefficients of the fluid injection device. The pressure of the gas source, the pulses per second and duty cycle of the solenoid valve, and the length of time of valve operation, all contribute to determining the amount of gas delivered into the concentrate for the requested beverage. While not depicted in FIG. 3, the concentrate system 30 may include a pressure regulator which operates to control the pressure from the gas source to a consistent pressure. Control of these gas delivery variables can result in the delivery of a known amount of gas into the concentrate for each dispensed drink portion. The gas may be injected into the concentrate at rates between 0.05 L/min-1.0 L/min. A more specific range is between 0.05 L/min and 0.2 L/min. Examples within that range include, but are not limited to 0.05, 0.1, 0.15, or 0.2 L/min. Table 1 provides the results of experimental examples as obtained from testing using the S10MM solenoid valve as described above.

TABLE 1

| Test | On Time (ms) | Total Time (ms) | OFF Time (ms) | PPS | Duty Cycle (%) | Gas Delivery (ms/second) |
|---|---|---|---|---|---|---|
| 1 | 50 | 130 | 80 | 7.7 | 38% | 384.6 |
| 2 | 50 | 120 | 70 | 8.3 | 42% | 416.7 |
| 3 | 50 | 110 | 60 | 9.1 | 45% | 454.5 |
| 4 | 50 | 100 | 50 | 10.0 | 50% | 500.0 |
| 5 | 50 | 90 | 40 | 11.1 | 56% | 555.6 |

This control of the amount of the gas injected into the concentrate is further facilitated by the direction of the concentrate through the cooling coil 19 prior to combining with the gas in the Venturi fitting 59. The chilled concentrate is not only more viscous when at a lower temperature, but the concentrate is at a consistent temperature, and therefore at a consistent viscosity during gas injection. Consistency of the concentrate temperature helps, along with the control of the solenoid, to achieve the gasification result. While not depicted in FIG. 3, in examples, the gas may also be chilled, for example with the use of a further cooling coil in the cooling bath, so that the gas does not further warm the concentrate.

The base fluid system 20 and the concentrate system 30, join at the fitting 50. While dispensing valve 24 is closed, the system is held in a relatively stable pressurized state. Once the dispensing valve 24 is opened, the pressure of the systems force base fluid and the concentrate out of the nozzle to dispense the beverage. In examples, the base fluid and the concentrate may mix at the fitting 50, may mix in the nozzle 11, or may be dispensed so as to be mixed in the cup positioned below the nozzle. In the dispensing machine 10, the dispensing valve 24, or valves, are electrically connected to the solenoid valve 55, such that when the dispensing valve 24 associated with the concentrate opens, thus dispensing the concentrate or a combined base fluid and concentrate, the solenoid valve 55 operates to gasify the concentrate as described above. The dispensing valve 24 may be directly connected to the solenoid valve 55, or the dispensing valve 24 may be electrically connected to the solenoid valve 55 through a controller 200 implemented as a microprocessor on a printed circuit board (PCB) and other components associated therewith.

Figure 5:
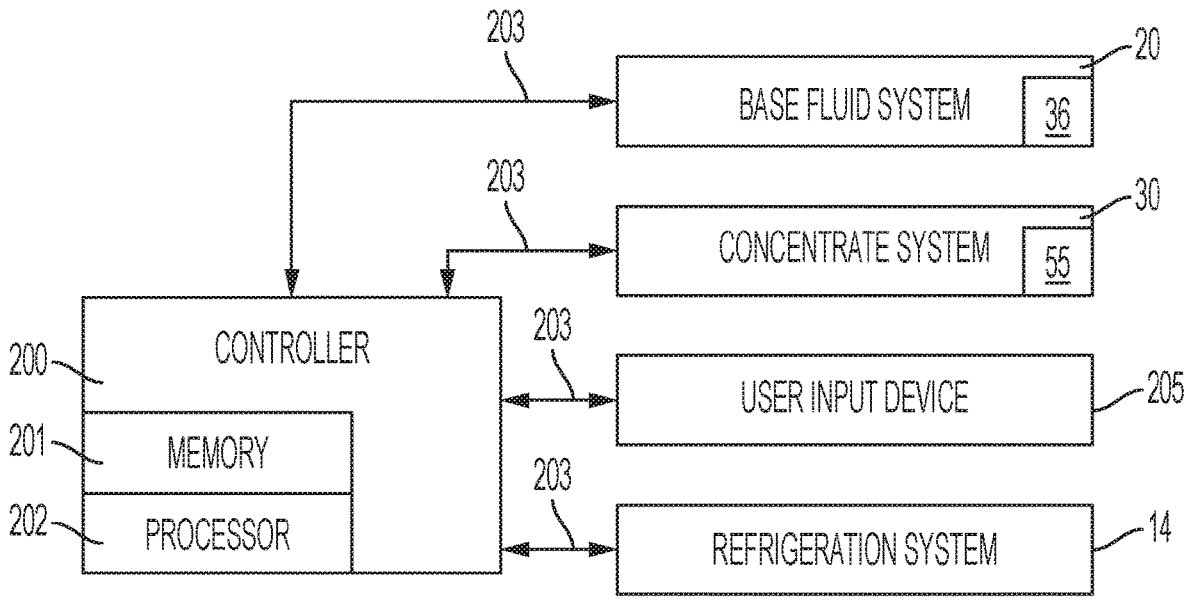
FIG. 5 is an example control system according to the present disclosure.

FIG. 5 depicts a computer control system for the beverage dispensing machine 10. The controller 200 has a memory 201 and a processor 202 and is programmed to control the open/close functionality of the above-described solenoid valve 55 such that the second gas is pulsated into the concentrate. The controller 200 can also be configured to control other components of the dispensing machine 10, including but not limited to, the base fluid system 20, the concentrate system 30, dispensing valve 24, user input device 205, components of the refrigeration system 14, to perform the functions as disclosed herein. The controller 200 is connected to the above-described components via communication links 203 which may be wired or wireless communicative connections.

The controller 200 can operate to provide control signals to the solenoid valve 55 to open and close at a predetermined rate, for example within the pulses per second ranges as described above. The gas control values of pulses per second and duty cycle may be stored in memory 201, for example as a lookup table with values based upon variables such as a concentrate identification, a measured temperature of the concentrate or of the cooling bath, and/or a measured gas source pressure. This data may be downloaded to the memory or may be entered by a technician or operator during a calibration or set up routine. In another example, the gas control values may be calculated based at least in part upon one or more of the measured concentrate or cooling bath temperatures, measured gas source pressure, and/or a measured downstream pressure or flow rate. In still further examples, a customer input of an amount or level (e.g. "light", "medium" "extra") of gasification may further be received by the controller 200 and associated to pulses per second or duty cycle values in the lookup table as well. In a still further example, this amount or level of gasification may be achieved by injecting the gas into a portion of the dispensed concentrate, with the ungassed concentrate lowering the overall level of gasification. Optionally, the controller 200 may operate the solenoid valve 55 according to gas control values stored in the memory as part of a particular beverage recipe. Upon receipt of an input to dispense the requested beverage recipe, the controller 200 may operate the dispenser according to these stored gas control values.

In addition to controlling the frequency of the solenoid operation, controller 200 can be further configured to vary the amount or volume of the gas injected into the concentrate. While the rate at which the solenoid valve is opened and closed creates agitation in the concentrate, which facilitates mixing, beverage recipes may further call for a specific amount of gas to be injected into the concentrate. The amount of gas injected into the concentrate depends upon the pressure of the gas, the duty cycle of the solenoid valve, and the length of time that the solenoid valve is operated. The controller 200 may further operate to provide control signals to the solenoid valve 55. In some examples, a concentrate having a relatively high degree Brix can be injected with greater amounts of the second gas in comparison to other concentrates having low degree Brix. The amount of the second gas injected into the concentrate can also be based on a received input of a consumer's preference or selection regarding the amount and/or types of gases that are in the mixed beverage.

The controller 200 can communicate with conventional pressure and/or temperature sensors (not shown) which sense the pressures and/or temperatures of the liquids and gasses in the base fluid system 20 and in the concentrated fluid system 30 The type and configuration of the pressure sensors can vary, examples of which including commercially available transducers, having a detection range between 0-100 psi, although other sensors will be recognized in view of the present disclosure. Based on signals from the pressure sensors, the controller 200 can be configured to control other components of the beverage dispensing machine 10 (e.g. the pumps, the check valves, the relief valves) to maintain different fluids at predetermined pressures. In some examples, the pressure of the gas in the concentrate system 30 is kept at or below a specific pressure or within a specific pressure range so that the gas is efficiently entrained into the concentrate. This can be empirically determined through experimentation. For example, when the mixed beverage is dispensed via the dispensing valve 24, the pressure of the gas-injected concentrate in the dispensing machine 10 drops to a minimum concentrate pressure (e.g., 50 PSI). In this example, the pressure of the second gas that is injected into the concentrate is kept less than a predetermined minimum concentrate pressure to ensure efficient injection into the concentrate and prevent the second gas from dispensing without the concentrate. Failure to keep the pressure of the second gas below or at the minimum concentrate pressure can result in the second gas being dispensed without the concentrate. In one example, the pressure of the second gas can be 5.0-10.0 PSI less than the minimum concentrate pressure. The controller 200 can advantageously be configured to control the concentrate pump 43 and/or the pressure of the second gas (e.g., with a pressure regulator) to thereby maintain the pressure of the second gas below the minimum concentrate pressure.

In one non-limiting example of operation, the controller 200 can receive an input, for example through user input device 205 to dispense a mixed beverage with only carbonation. When the dispensing valve 24 opens, the controller 200 maintains the solenoid valve 55 in a closed position such that the nitrogen gas does not inject into the concentrate. Thus, concentrate without nitrogen gas dispenses from the dispensing valve 24. In another example, the controller receives an input requesting a mixed beverage with only nitrogen gasification. When the dispensing valve 24 opens, the controller 200 dispenses still water from the base fluid system 20 and operates the concentrate system 30, and specifically the solenoid valve 55, to gasify the concentrate with nitrogen gas. In a still further example, the controller receives an input requesting a mixed beverage with both $CO_2$ and nitrogen gas. When the dispensing valve 24 opens, the controller 200 operates the base fluid system 20 to dispense carbonated water and operates the concentrate system 30, and specifically the solenoid valve 55, to gasify the concentrate with nitrogen gas.

Figure 6:
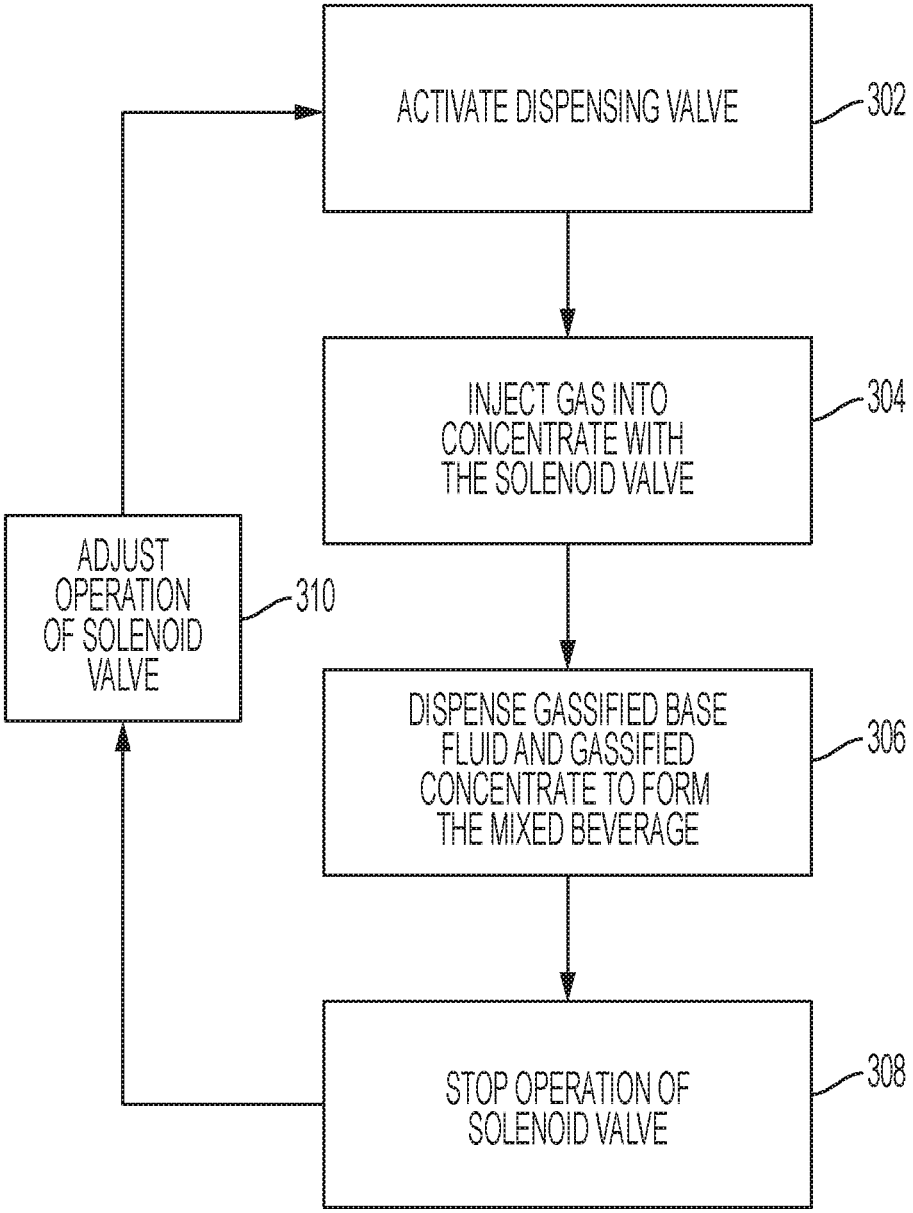
FIG. 6 is an example method according to the present disclosure.

FIG. 6 depicts an example method 300 for controlling the above-described dispensing machine 10, for example via the above-described controller 200. At 302 method begins with activation (e.g., opening) of the dispensing valve 24. The dispensing valve 24 is often activated upon a user input, which can, for example, be manual movement of a lever arm 25 or a touch input into the user input device 205, although dispense may be initiated based upon other automated inputs, for example, detection of a cup below the dispensing valve 24. Opening of the dispensing valve 24 releases the pressurized base fluid and concentrate out of the nozzle 11.

The dispensing valve 24 is electrically connected to the solenoid valve 55 of the concentrate system 30. At 304, opening of the dispensing valve initiates the operation of the solenoid valve 55. In examples, the dispensing valve 24 may be directly electrically connected to the solenoid valve 55, for example in a power or control circuit. In other examples, the dispensing valve 24 may be electrically connected to the solenoid valve through the controller 200, in which case, upon notification that the dispensing valve 24 is open, the controller 200 provides a control signal to the solenoid valve 55 to initiate operation as well. The solenoid valve 55 opens and closes to inject the gas in pulses into the concentrate. In non-limiting examples, the solenoid valve 55 opens and closes at a rate between 5-15 pulses per second.

The base fluid and the gasified concentrate are dispensed at 306 from the dispensing valve 24 into a cup or other receptacle to form the requested mixed beverage. In examples, the base fluid and the gasified concentrate are mixed internally to the dispenser at the fitting 50. In other examples, the base fluid and the gasified concentrate are mixed in the nozzle 11, prior to exiting the dispensing machine 10. In still further examples, the base fluid and the gasified concentrate exit the dispensing machine 10 in separate streams and mix within the cup. At 308, the dispensing valve 24 is deactivated (e.g., closed). If the solenoid valve 55 has not already been deactivated, then the operation of the solenoid valve 55 stops with the closure of the dispensing valve 24. Thus, no further concentrate is exiting the dispenser by way of the closure of the dispensing valve 24 and no further gas is injected into the concentrate through the solenoid valve 55. The method returns to box 302 once the dispensing valve 24 is reactivated to dispense a next mixed beverage.

Figure 7:
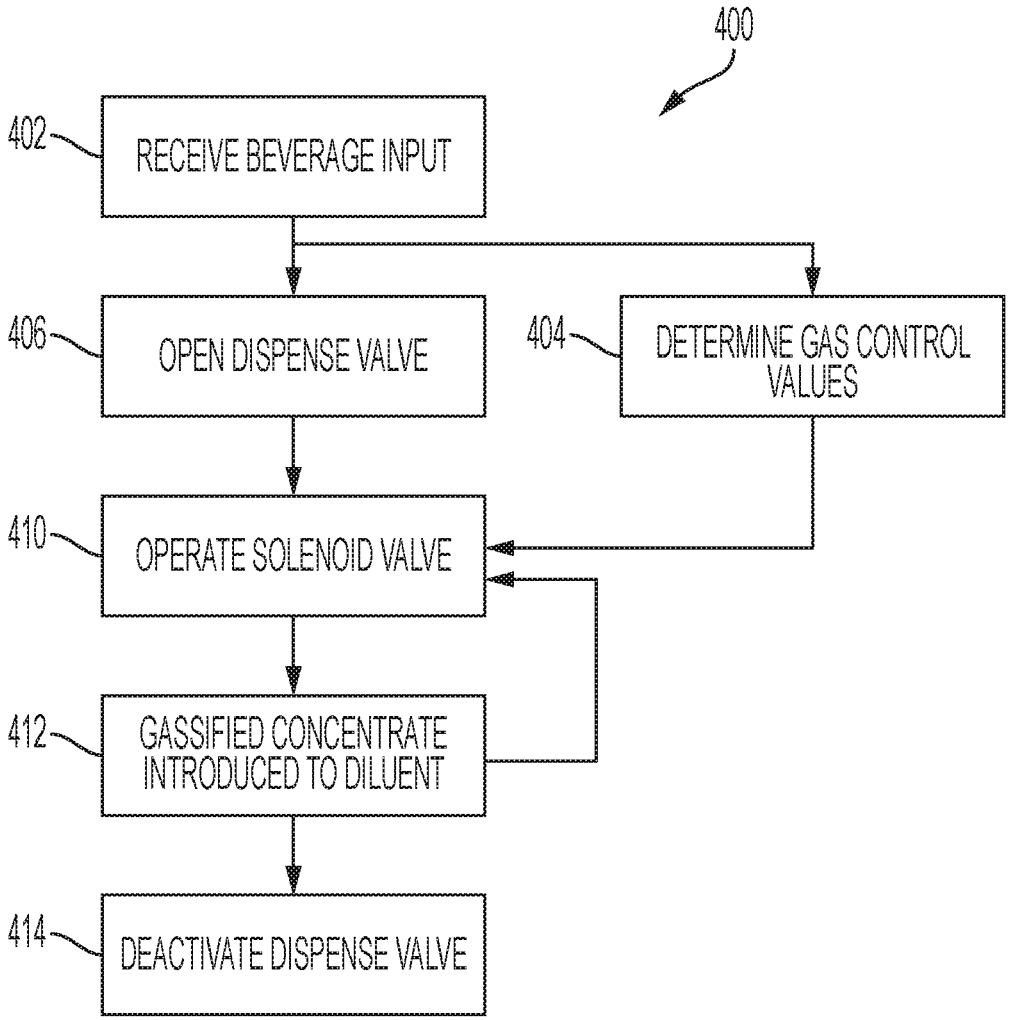
FIG. 7 is another example method according to the present disclosure.

In certain examples, the method depicted in FIG. 6 includes the step of adjusting (e.g., increasing/decreasing), with the controller 200, the gas control values used to operate the solenoid valve 55 to carry out the dispense, For example, the gas control values may be adjusted depending upon a requested mixed beverage, concentrate, or gasification level for the dispense, or may be dependent upon measured pressures or temperatures within the dispenser. The FIG. 7 depicts another example method 400 according to the present disclosure. At 402 the method begins with the controller receiving an input of a requested beverage to be dispensed by the dispenser. The requested beverage requires at least one concentrate and at least one base fluid diluent. The requested beverage further requires gasification. In a dispenser configured to dispense a single mixed beverage from each nozzle, the input of the requested beverage may be made by activation of the lever arm 25 or a dispense button associated with the dedicated nozzle. In such examples, this input not only selects the beverage but also initiates dispense discussed below at 406. In other examples, a nozzle is capable of dispensing a variety of mixed beverages, differing either in gasification, base fluid, or concentrate. In such examples, an initial input is received at 402 to identify the mixed beverage to be dispensed.

At 404 the controller 100 determines, gas control values for the gasification of the concentrate-based upon either the requested mixed beverage or measured temperature or pressure conditions within the dispenser, or both. The gas control values may exemplarily be a pulse rate (in pulses per second), a duty cycle, and an operation time for the solenoid valve. The determination at 404 may include use or one or more lookup tables stored in the memory 201 of the controller based upon either the identification of the requested beverage and a recipe (e.g. base fluid, one or more concentrates, and gasification) therefor or the measured temperature or pressure conditions within the dispenser. Alternatively, some or all of the gas control values may be directly received by separate input. In still further examples, the controller 200 can contain algorithms stored on the memory 201 and execute such algorithms to calculate the gas control values from the above-noted measurements and/or other information including, but not limited to a concentrate viscosity, Brix, or density. Such algorithms can be programmed into the controller 200 at set up of the dispensing machine 10 and in examples, such algorithms or lookup table values may have been empirically determined.

At 406 the dispensing valve 24 is opened to initiate the dispense of the requested beverage. The dispensing valve 24 is often activated to an open condition upon a user input, which can, for example, be manual movement of a lever arm 25, as discussed above, or a touch input into the user input device 205, although dispense may be initiated based upon other automated inputs, for example, detection of a cup below the dispensing valve 24. Upon opening of the dispensing valve 24, the base fluid and the concentrate, held under pressure are dispensed through the dispense valve 24 and the nozzle 11. The concentrate may be held at a constant refrigerated temperature, (e.g. 45° F.) which increases the viscosity of the concentrate compared to an ambient temperature, and simplifies the determination of the gas control values by providing a concentrate with more consistent physical characteristics. In another example, the concentrate may be dispensed by activation of an associated pump in conjunction with the opening of the dispensing valve 24.

At 410, opening of the dispensing valve initiates the operation of the solenoid valve 55. The solenoid valve 55 is operated according to the gas control values determined at 404. In examples, the dispensing valve 24 may be directly electrically connected to the solenoid valve 55, for example in a power or control circuit. In other examples, the dispensing valve 24 may be electrically connected to the solenoid valve through the controller 200, in which case, upon notification that the dispensing valve 24 is open, the controller 200 provides a control signal to the solenoid valve 55 to initiate operation as well. The solenoid valve 55 opens and closes to inject the gas in pulses into the concentrate. In non-limiting examples, the solenoid valve 55 opens and closes at a rate between 5-15 pulses per second. This agitates the concentrate, creating turbulent flow and shear within the concentrate, which has been discovered to provide improved gasification of the concentrate over continuous gas injection, resulting in the concentrate being able to entrain a greater volume of gas per unit of concentrate.

At 412, the diluent and the gas-injected concentrate are dispensed from the dispensing valve 24 and the mixed beverage is formed. After the gas is injected into the condensed syrup, but before the base fluid and the gasified concentrate are mixed, the gasified concentrate may pass through a Venturi opening to increase the velocity of the gasified concentrate and further mix the gas and concentrate and entrain the gas within the concentrate. The base fluid and the gasified concentrate may be mixed internal to the dispenser at the fitting 50, may be mixed in the nozzle 11, or may be mixed in the cup or other receptacle positioned below the nozzle 11. Depending upon a gas control value of a gas dispense time or gas dispense volume, which may be determined relative to a received input or recipe input of a gasification amount, the controller 200 may operate the solenoid valve 55 to close prior to the termination of the dispense of the mixed beverage through operation of the dispensing valve 24. In such a manner, the dispenser may operate to provide a "lightly" gasified mixed beverage. After the mixed beverage is dispensed, the dispensing valve 24 is deactivated (e.g., closed) and if it is not already, the solenoid valve 55 is also deactivated. The method returns to 402 when the dispensing valve 24 is reactivated to dispense a next mixed beverage.

It will thus be seen that through research and experimentation, the present inventor discovered that pulsing the second gas into the concentrate advantageously agitates the concentrate such that the second gas more easily injects and mixes into the concentrate. The present inventor also discovered that in certain examples a concentrate with a high sugar content (e.g., high degree Brix) may require high-frequency pulsing of the second gas to efficiently inject the second gas into the concentrate in comparison to a concentrate with a low sugar content (e.g. low degree Brix). For example, a concentrate with a sugar content of 8.5 degree Brix may require a pulse rate of 6.67 pulses per second and a concentrate with a sugar content of 11.8 degree Brix may require a pulse rate of 4.0 pulses per second. It will be recognized that other pulse rates between 4-15 pulses per second may also be used.

Furthermore, the present inventor discovered that in certain examples a high duty cycle of the solenoid valve 55 can create an increased "cascading" effect of the mixed beverage in the cup. For example, a 75.0% duty cycle may result in 90 seconds of the "cascading" effect while a 50.0% duty cycle may result in 60 seconds of the "cascading" effect. It will be recognized that other duty cycles as described above may also be used.

In another example, gas injection into the concentrate can also be accomplished with a needle valve (not shown) without or with minimal pulsing of the gas into the concentrate. In this example, the needle valve controls the volumetric flow of the gas to the concentrate.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives, and modifications are possible within the scope of the appended claims.

What is claimed is:

1. A beverage dispensing machine for dispensing a mixed beverage, the beverage dispensing machine comprising:

a first inlet configured to receive a concentrate;

a second inlet configured to receive a base fluid;

a gas inlet configured to receive a gas;

an injection chamber fluidly connected downstream of the first inlet and downstream of the gas inlet, the injection chamber configured to receive the concentrate and the gas;

an injection valve fluidly connected between the gas inlet and the injection chamber and configured to pulsate the gas into the concentrate in the injection chamber such that the gas agitates the concentrate and the gas is entrained in the concentrate to form a gassified concentrate;

a dispensing valve connected downstream of the second inlet and downstream of the injection chamber, the dispensing valve configured to dispense the base fluid and the gassified concentrate, wherein the injection valve is activated upon opening of the dispensing valve; and a controller that electrically connects the dispensing valve to the injection valve, wherein the controller operates to control at least one of a pulse rate and a duty cycle of the operation of the injection valve.

2. The beverage dispensing machine according to claim 1, wherein the dispensing valve is configured to dispense the gas-injected concentrate and the base fluid separately into a container to thereby form the mixed beverage.

3. The beverage dispensing machine according to claim 1, wherein the dispensing valve is configured to mix the gassified concentrate and the base fluid within a nozzle.

4. The beverage dispensing machine according to claim 1, wherein the injection valve is a solenoid valve.

5. The beverage dispensing machine of claim 1, wherein the pulse rate is between 5-15 pulses per second.

6. The beverage dispensing machine of claim 1, wherein the controller is configured to operate the injection valve at a duty cycle between 25%-75% when the dispensing valve is open.

7. The beverage dispensing machine of claim 1, wherein the gas comprises nitrogen.

8. A beverage dispensing machine for dispensing a mixed beverage, the beverage dispensing machine comprising:

a first inlet configured to receive a concentrate;

a second inlet configured to receive a base fluid;

a gas inlet configured to receive a gas;

an injection chamber fluidly connected downstream of the first inlet and downstream of the gas inlet, the injection chamber configured to receive the concentrate and the gas, wherein the injection chamber comprises a Venturi opening configured to increase a flow velocity of the concentrate and the gas through the Venturi opening;

an injection valve fluidly connected between the gas inlet and the injection chamber and configured to pulsate the gas into the concentrate in the injection chamber such that the gas agitates the concentrate and the gas is entrained in the concentrate to form a gassified concentrate;

a dispensing valve connected downstream of the second inlet and downstream of the injection chamber, the dispensing valve configured to dispense the base fluid and the gassified concentrate;

a cooling coil disposed between the first inlet and the injection chamber, the cooling coil configured to cool the concentrate to a predetermined temperature; and a controller configured to electrically connect the injection valve to the dispensing valve, to activate the injection valve upon an opening of the dispensing valve, and to control at least one of a pulse rate of the injection valve and a duty cycle of the injection valve, wherein the controller operates to control the pulse rate between 5-15 pulses per second and operates to control the duty cycle at which the valve is open between 25%-75%.

9. The beverage dispensing machine of claim 8, wherein the Venturi opening is configured to increase a flow velocity of the concentrate and the gas to shear thin the concentrate and increase entrainment of the gas in the concentrate.

10. The beverage dispensing machine of claim 8, further comprising a chilled media bath surrounding the cooling coil and configured to cool the cooling coil.

11. The beverage dispensing machine of claim 8, wherein the gas comprises nitrogen.

12. The beverage dispensing machine of claim 11, further comprising a carbonator fluidly connected between the second inlet and the dispensing valve, wherein the carbonator carbonates the base fluid.

13. The beverage dispensing machine according to claim 8, wherein the dispensing valve is configured to dispense the gas-injected concentrate and the base fluid separately into a container to thereby form the mixed beverage.

14. The beverage dispensing machine according to claim 8, wherein the dispensing valve is configured to mix the gassified concentrate and the base fluid within a nozzle.

15. The beverage dispensing machine according to claim 8, wherein the injection valve is a solenoid valve.

* * * * *